United States Patent [19]

Müller

[11] 3,983,926

[45] Oct. 5, 1976

[54] AUTOMATIC CLAMPING OF MOULDING BOXES

[75] Inventor: Gunter Müller, Karlsruhe, Germany

[73] Assignee: Badische Maschinenfabrik GmbH, Germany

[22] Filed: Nov. 22, 1974

[21] Appl. No.: 526,403

[30] Foreign Application Priority Data

Nov. 28, 1973 Germany ..... 2359165

[52] U.S. Cl. ..... 164/386; 294/67 BC; 294/88

[51] Int. Cl.[2] ..... B22C 21/08; B66C 1/10

[58] Field of Search ..... 164/384, 385, 386, 387, 164/388, 390, 401, 404, 405, 406, 407, 408, 409; 294/88, 67 BC, 106, 67 R; 425/253; 224/45 G, 48 F

[56] References Cited

UNITED STATES PATENTS

| | | | |
|---|---|---|---|
| 1,027,695 | 5/1912 | Covert | 164/384 X |
| 1,526,765 | 2/1925 | Anderson | 164/401 |
| 1,734,176 | 11/1929 | McCabe | 164/404 X |
| 1,865,380 | 6/1932 | Moore | 294/106 |
| 2,726,429 | 12/1955 | Duncan | 164/409 X |
| 2,984,176 | 5/1961 | Sommer | 164/412 UX |
| 3,045,300 | 7/1962 | Stuckey | 164/408 X |
| 3,257,142 | 6/1966 | Barry | 294/67 BC X |

*Primary Examiner*—Francis S. Husar
*Assistant Examiner*—John S. Brown
*Attorney, Agent, or Firm*—Craig & Antonelli

[57] ABSTRACT

Foundry moulding boxes are automatically clamped together or to a supporting plate by means of loose clamps (as distinct from clamps which are permanently fixed to a moulding box or to an individual carriage supporting the boxes) which are spring loaded and are brought by combined preloading and moving devices into the region of the parts which are to be clamped by allowing the springs to relax and transmit the preload to those parts via abutment members of the clamps which engage therewith. The clamps are carried by respective stirrups which are pivotably attached to a mobile carriage running on rails to convey the clamps from an unclamping station to a clamping station where the clamps are left in clamping engagement with a pair of moulding boxes while the stirrups return with the carriage to remove the clamps from another such pair. The stirrups incorporate drives for preloading the clamps and opening up the gap between the abutment members. Part of the mobile carriage is movable by another drive for engaging the stirrups with the clamps, and disengaging them therefrom, after the stirrups have been swung into position by other drives provided on the carriage to cause pivotal movement of the stirrups.

8 Claims, 5 Drawing Figures

AUTOMATIC CLAMPING OF MOULDING BOXES

The invention relates to a method of and an apparatus for the automatic clamping and unclamping of foundry moulding boxes, for use more particularly in automatic moulding installations.

Various automatic clamping apparatus are already known. One kind operates with elastic clamping bolts which remain permanently on one box part and can be combined with the centring devices for the two box parts (for example German Pat. No. 1,156,541, German Utility Model No. 1,786,128). At the clamping and unclamping station first of all by rods situated precisely above the clamping bolt the spring is subjected to preload by downward pressure and then the same rod system causes the clamping bolt to be turned for locking purposes. Then the rod system is moved upwards again so that the spring force bears against the two halves of the moulding box. Then unclamping is effected in the reverse order. This apparatus has the disadvantages that each upper box contains at least two such mobile parts, and this make the moulding boxes expensive, and these mobile parts may be subjected to wear during jolting on the moulding machine.

An apparatus for the mechanical clamping of moulding boxes is also known (German Pat. No. 1,174,944) which can be used only in a limited way in co-operation with individual carriages which are moved in a timed manner and which support the moulding boxes. Since these clamping apparatus are connected securely to the individual carriages, the number of such apparatus is determined by the number of individual carriages, which involves a correspondingly high outlay.

Another clamping apparatus operates with loose clamps which are C-shaped, which do not remain permanently on the moulding box, and which bring about the compression of the box parts by a positively acting wedge effect. The disadvantage of this apparatus is that in the case of automatic operation a very complicated moving apparatus is required in order to close the loose clamps and to open the clamps which are wedged with greatly differing amounts of tightness. Reliable operation is not possible in this way. Also, the closing pressure is lost if there is even very slight wear at the bearing contact surface of the clamp, so that the apparatus can perform its task only if frequently repaired.

The present invention has as its object to combine with one another only the advantageous properties of the two systems, namely on the one hand loose parts which are connected fixedly neither to moulding boxes nor to individual carriages, and on the other hand the use of elastic parts the action of which is not influenced by wear.

According to the present invention, there is provided a method for the automatic clamping of moulding boxes by means of apparatus comprising at least two clamps kept under preload, by respective springs which are relaxed in transmitting the preload to the parts which are to be clamped, in which method the said clamps are loose clamps which are brought by combined preloading and moving devices into the region of the parts which are to be clamped.

The invention also provides apparatus for carrying out such method, in which apparatus each of the said clamps comprises a headed bolt with a pressure member, and between the bolt head and the pressure member there are provided a clamping spring and a sleeve with a holding dog, the said sleeve being guided on the bolt shank and bearing on the spring.

According to a preferred feature of the invention it is also proposed that a mobile carriage supports at least one yoke which is adapted to move in a vertical direction by means of a drive and on whose ends there are pivotably mounted the clamping arms or stirrups which are pivotable by means of drives.

The parts which are to be clamped are usually upper and lower boxes. But it is possible with the same means to clamp a pair of boxes against a loose supporting plate or against the platform of a floor conveyor carriage. Conveniently, in an automatic moulding installation, when using loose clamps, the clamping and unclamping stations will be situated as close together as possible so as to obtain the shortest possible distance for transporting the parts involved, and to manage with only one clamp conveying carriage. If a relatively considerable spacing is unavoidable, it is possible to operate with two clamp supporting carriages, in which case each has to travel over half the total distance and the clamps are deposited at an intermediate station.

Embodiments of the invention will now be described, by way of example showing further details, with reference to the accompanying drawings in which.

Figure 1:
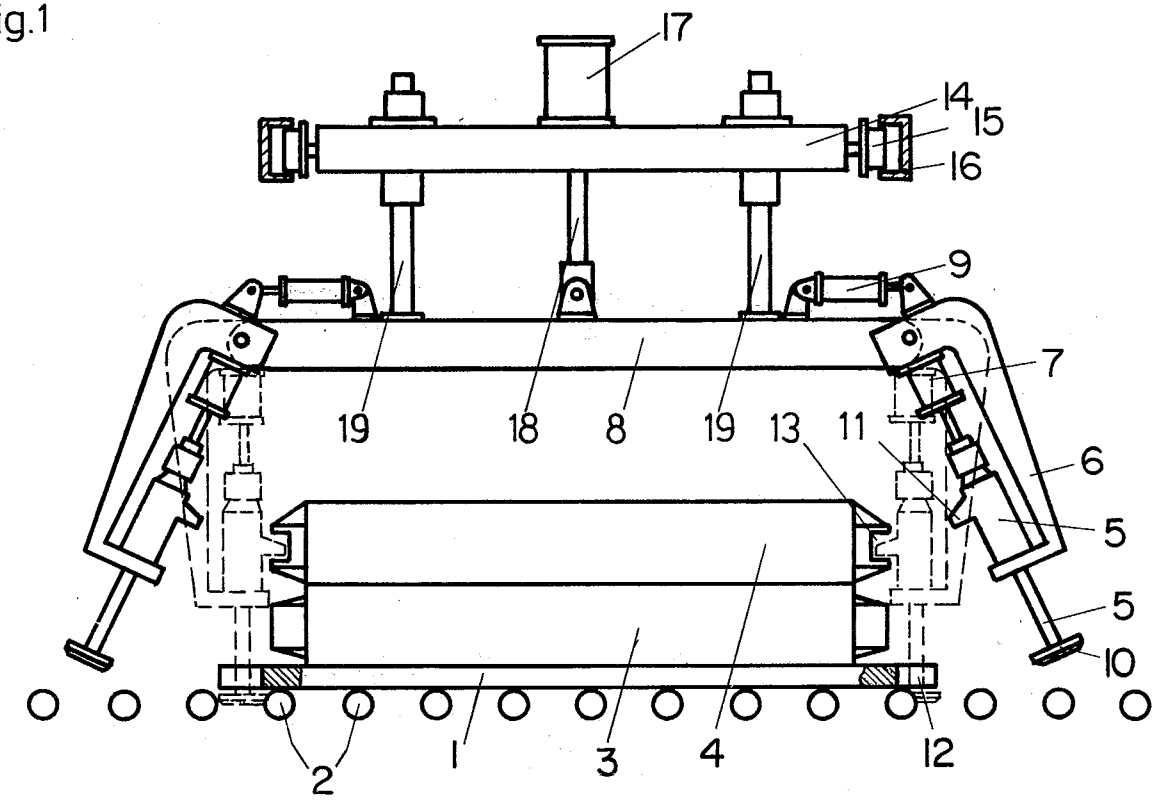
FIG. 1 shows a clamping apparatus for the clamping of moulding boxes to their supporting plate.

FIG. 1 shows a supporting plate 1 for moulding box parts 3 and 4 for conveyance along a roller track 2. A clamp 5 is held in a preloaded position in an arm of stirrup 6 by a drive 7. A drive 9 on a yoke 8 holds the stirrup 6 in the swung-out position. In the clamping position (brokenline representation in FIG. 1) a holding dog 11 is situated in a recess 13 and a bolt head 10 bears on a bearing portion 12. The representation of the holding dog 11 and recess 13 is only to be regarded as a sketch illustrating the basic principle, since in actual practice the action of force is effected symmetrically for the purpose of guiding a sleeve 26 (see FIG. 2) by means of two diametral holding dogs.

A carriage 14 with running wheels 15 in rails 16 carries a vertically acting drive 17 which, by means of a rod 18, can move the yoke 8 with guides 19 upwards and downwards. A drive (not shown) moves the carriage 14 horizontally to and fro between a clamping station and an unclamping station within a moulding-box cycle of movement. The distance from the unclamping station to the clamping station is traversed with the clamps 5 whereas in the opposite direction there is an idle travel without clamps.

Figure 2:
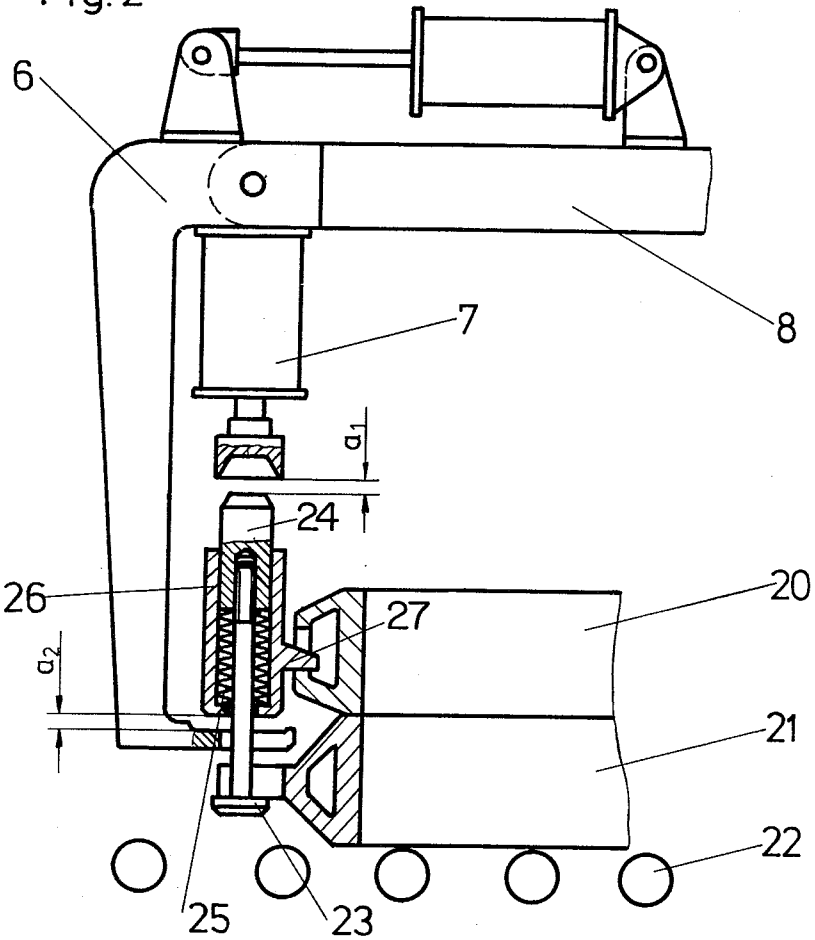
FIG. 2 shows a clamping apparatus for clamping upper and lower box parts, partly in section.
Figure 5:
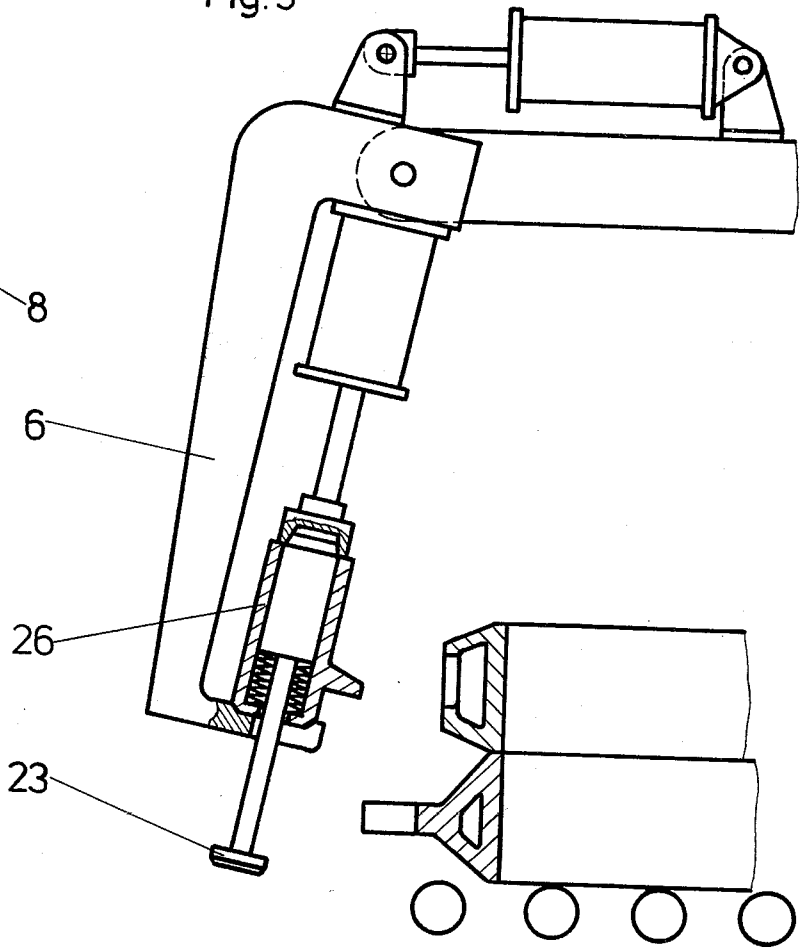
FIG. 5 shows a clamping apparatus as in FIG. 4 with a stirrup swung out.

FIG. 2 shows two clamped moulding box parts 20 and 21 on a roller track 22 without a supporting plate. A possible construction for a clamp comprises a headed bolt 23 with pressure member 24, preloading spring 25 and sleeve 26. The stirrup 6 is shown situated in a swung-in position. The clearances $a_1$ and $a_2$ are required for the swinging-in movement. The yoke 8 is shown situated in its lowest position.

Figure 3:
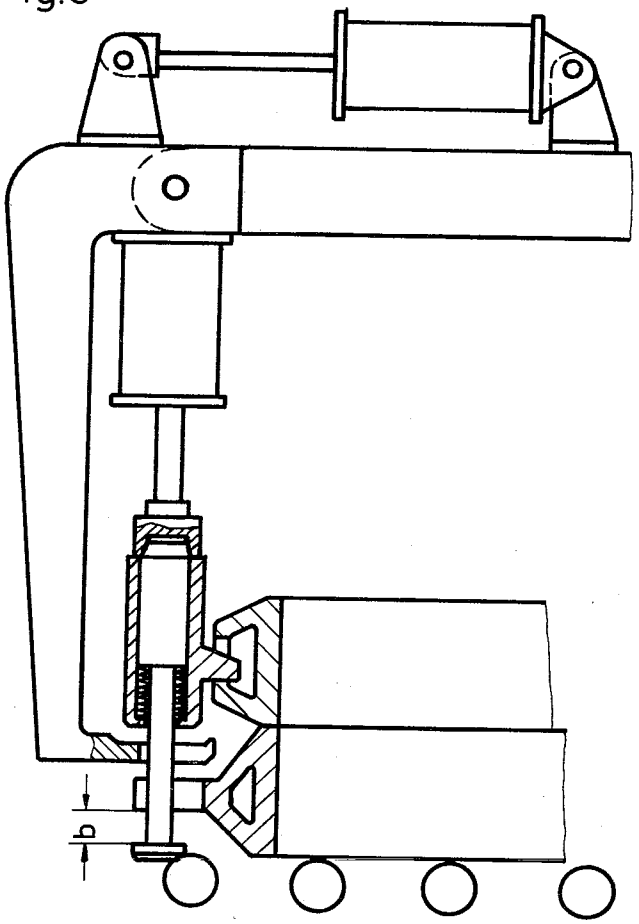
FIG. 3 shows a clamping apparatus as in FIG. 2 with a clamp opened.

FIG. 3 shows, as the next operation for unclamping, the opening of the lower clamp part 23 by the amount *b* by operation of the drive 7.

Figure 4:
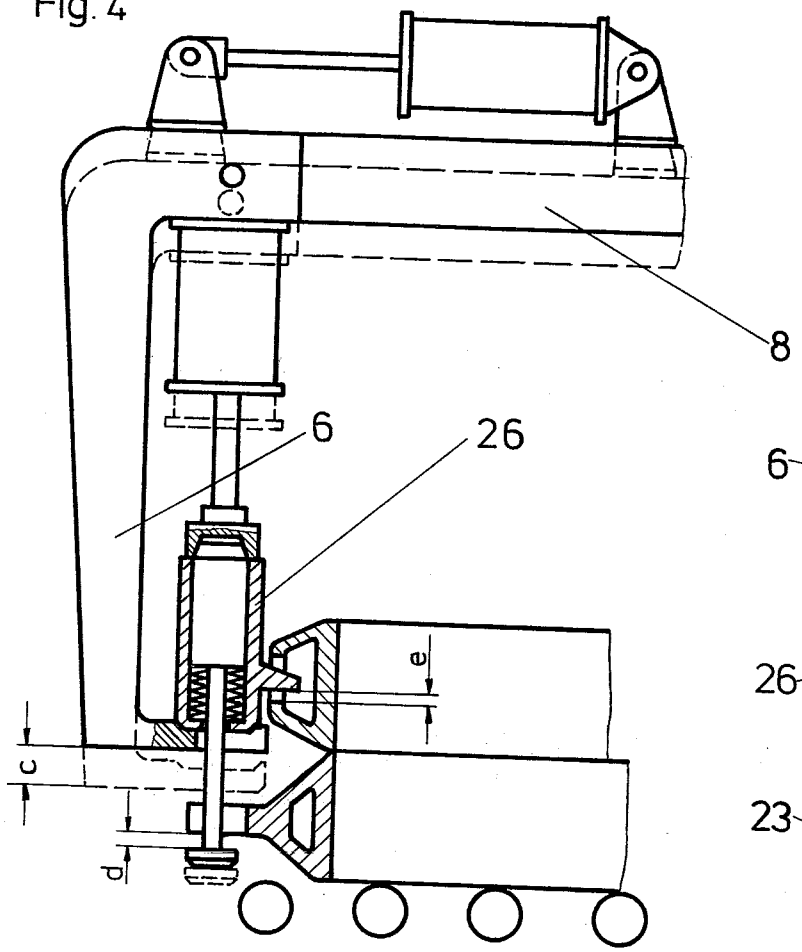
FIG. 4 shows a clamping apparatus as in FIG. 3 with a yoke raised.

FIG. 4 shows, the opening movement of the upper clamp part 26 by the amount *e*, by lifting the stirrup 6 with the crossmember 8 by the amount *c* with the help of the Vertical drive 17 (see FIG. 1). The spacing *b* in FIG. 3 is reduced to the amount *d*. With the clearances *d* and *e* the clamp 5 can swing out in the stirrup 6 and run with the carriage 14 to the clamping station. There, clamping takes place in the reverse sequence, whereupon the empty stirrup 6 returns and, after swinging in again, takes up the position shown in FIG. 2.

The invention is not limited to the illustrated example. but other constructional forms are possible which carry into effect the features of the invention.

What is claimed is:

1. Apparatus for the automatic clamping together of moulding boxes comprising at least two-spring loaded clamps wherein, by relaxation of the clamp springs, tension is transmitted to the moulding boxes to be clamped together, characterized in that the clamps are movable and can be fixedly attached to and released and removed from the clamped-together moulding boxes by means on said clamps for tensioning and relaxing of the clamp springs and means operatively connected to said clamps for the engagement and disengagement of the clamps from the moulding boxes.

2. Apparatus for the automatic clamping together of moulding boxes comprising at least two spring-loaded clamps wherein, by relaxation of the clamp springs, tension is transmitted to the moulding boxes to be clamped together, the clamps are movable and can be fixedly attached to and released from the moulding boxes by means for tensioning and relaxing of the clamp springs and means for the engagement and disengagement of the clamps, wherein each spring clamp comprises a headed bolt with a pressure member and a sleeve with a holding dog, whereby the headed bolt constitutes one jaw of the spring clamp and the holding dog constitutes a second jaw of the spring clamp, and the spring is effectively connected between the pressure and the sleeve.

3. Apparatus for the automatic clamping together of moulding boxes comprising at least two spring-loaded clamps wherein, by relaxation of the clamp springs, tension is transmitted to the moulding boxes to be clamped together, the clamps are movable and can be fixedly attached to and released and removed from the moulding boxes by means for tensioning and relaxing of the clamp springs and means for the engagement and disengagement of the clamps, wherein the means for fixedly attaching and releasing and removing the clamps from the moulding boxes is operatively arranged on a movable carriage having a vertically displaceable yoke whose ends carry the means for tensioning and relaxing of the clamp springs and means for the engagement and disengagement of the clamps.

4. Apparatus according to claim 3, wherein the means for the engagement and disengagement of the clamps include stirrups pivotally mounted at one end to the yoke and engaging the clamps at their other end.

5. Apparatus according to claim 4, in which apparatus each of the said clamps comprises a headed bolt with a pressure member, and between the bolt head and the pressure member there are provided a clamping spring and a sleeve with a holding dog, the said sleeve being guided on the bolt shank and bearing on the spring.

6. Apparatus according to claim 4, wherein the means for tensioning and relaxing of the clamp springs comprise pressure-medium drive cylinders operatively arranged between the one end of the stirrup and the spring clamps.

7. Apparatus according to claim 6, in which apparatus each of the said clamps comprises a headed bolt with a pressure member, and between the bolt head and the pressure member there are provided a clamping spring and a sleeve with a holding dog, the said sleeve being guided on the bolt shank and bearing on the spring.

8. Apparatus according to claim 6, wherein said pressure-medium drive also serves as means for fixing the spring clamp to the stirrup during the engagement and disengagement of the clamps.

* * * * *